US005315940A

United States Patent [19]

Kasseck

[11] Patent Number: 5,315,940

[45] Date of Patent: May 31, 1994

[54] PROCESS AND APPARATUS FOR THE TREATMENT OF MOIST GAS-DUST MIXTURES

[75] Inventor: Klaus Kasseck, Korschenbroich, Fed. Rep. of Germany

[73] Assignee: Loesche GmbH, Dusseldorf, Fed. Rep. of Germany

[21] Appl. No.: 789,263

[22] Filed: Nov. 8, 1991

[30] Foreign Application Priority Data

Nov. 9, 1990 [DE] Fed. Rep. of Germany ..... 4035730

[51] Int. Cl.[5] ..... F23J 11/00

[52] U.S. Cl. ..... 110/345; 431/353; 34/478; 110/264; 110/265

[58] Field of Search ..... 110/263-265, 110/345; 431/350, 353; 34/22, 26, 30, 32

[56] References Cited

U.S. PATENT DOCUMENTS

| | | | |
|---|---|---|---|
| 2,777,407 | 1/1957 | Schindler | 110/266 |
| 3,319,346 | 5/1967 | Schuster | 34/32 |
| 3,589,315 | 6/1971 | Hart | 431/353 |
| 4,162,890 | 7/1979 | Hirose | 431/353 |
| 4,213,501 | 7/1980 | Pfeiffer et al. | 431/353 |
| 4,384,846 | 5/1983 | Waldhofer | 431/350 |
| 4,509,272 | 4/1985 | Graff | 34/32 |
| 4,551,090 | 11/1985 | Leikert et al. | 110/265 |
| 4,858,538 | 8/1989 | Kuypers et al. | 110/264 |

FOREIGN PATENT DOCUMENTS

| | | |
|---|---|---|
| 227088 | 7/1991 | European Pat. Off. . |
| 3545828 | 7/1987 | Fed. Rep. of Germany . |
| 3734359 | 4/1989 | Fed. Rep. of Germany . |

OTHER PUBLICATIONS

Verfahrenstechnische Gesichtspunkte für Kohle-Mahl-Trocknungsanlagen in druckstossfester Bauweise mit Druckentlastung by Von L. T. Schneider (pp. 230-238).

*Primary Examiner*—Henry C. Yuen
*Attorney, Agent, or Firm*—Keck, Mahin & Cate

[57] ABSTRACT

The invention relates to a process and an apparatus for the treatment of moist, explosive gas-dust mixtures, particularly coal dust mixtures in mill drying plants. To avoid a condensing out of residual moisture from intermediately stored dust, heated inert gas is supplied to the conveying system for the coal dust or the intermediate storage points.

9 Claims, 3 Drawing Sheets

INERT GAS TANK
12
6
14
8
7
3
18
5
22
HEATED PROCESS GAS
16
9
15
PROCESS GAS TO BE HEATED
HEATED INERTGAS
RAW COAL
SURROUNDINGS
MILL DRYING PLANT
STORAGE MEANS
COAL DUST
FILTER MEANS
COAL DUST GAS MIXTURE
INERTGAS
COAL DUST
SURROUNDINGS
PROCESS GAS
COMBUSTION

PROCESS AND APPARATUS FOR THE TREATMENT OF MOIST GAS-DUST MIXTURES

BACKGROUND OF THE INVENTION

The invention relates to a process and an apparatus for the treatment of moist, explosive gas-dust mixtures, particularly coal dust mixtures in mill drying plants.

In processes of this type, which are well known in blast furnace and coalfired power station technology and which are described hereinafter in exemplified manner by means of the conditioning of moist raw coal to air-coal dust mixtures, it has hitherto been conventional practice to use a flue gas flow. The mills used in milling the moist raw coal are flowed through during the mill drying process by flue gas and hot process gas. As a result of this flue gas flow, a large part of the moisture in the raw coal is evaporated, so that the flue gas blown into the mill can be simultaneously used as a conveying medium for the coal dust mixture through the pipes and following dust collectors.

As frequently different capacities are encountered in the milling process in mills and the subsequent combustion of the coal dust mixture, the coal dust is discharged from the mill drying plant following the dust collectors and is intermediately stored in silos or storage bins.

In order to prevent coal dust explosions, deflagrations, etc. during the transportation of the coal dust mixture or during the intermediate storage of the coal dust, use is made of an injection of cold inert gas in such a way that explosive mixture formation is avoided.

However, longer transportation paths for the coal dust mixture, also within the framework of the flue gas flow, as well as the supply of cold inert gas in the following phases such as e.g. intermediate storage, lead to the temperature of the dust mixture or dust in a silo dropping below the dew point temperature of steam and consequently there is condensation of the residual moisture in the dust mixture or dust.

Even this condensation of residual moisture, frequently leads to agglomerations of the coal dust, which in turn leads to problems during the discharge of the coal dust mixture by means of the gas flow. As a result deposits can form in the pipe system and in particular blockages can occur in injection nozzles via which the coal dust mixture is e.g. supplied into the burners of blast furnaces.

In particular when storing coal dust in bins, such a condensation occurs in the cooler areas, so that a head or top heating, such as is frequently carried out, in the upper region of the storage bin fails to obviate this problem.

SUMMARY OF THE INVENTION

Bearing in mind these problems, the object of the invention is to provide a process and an economic apparatus of the aforementioned type by means of which in the case of explosion-critical gas-dust mixtures of materials improvements can be obtained for the following fluid transport, whilst ensuring minimum maintenance in the plants used.

According to the invention this object is achieved by the use of an inert gas heated or preheated to a temperature above the dew point temperature of the residual moisture of the dust mixture.

Whereas in known processes solely a hot process gas in addition to a cold inert gas is used, in the present invention a hot process gas and an additional extraneous inert gas is used which is heated above the dew point temperature of the residual moisture of the dust mixture. Therefore a secure transportation and storage of the dust is obtained, even when the generation of the hot process gas is stopped.

This solution avoids the serious problem of a condensation of the residual moisture present in the coal dust and therefore an agglomeration of the dust particles. Preferably heating takes place to approximately 30 ° C. above the dew point temperature, so as to reliably prevent condensation. As inert gases use is preferably made of nitrogen gas ($N_2$) or carbon dioxide ($CO_2$). Particularly on injecting coal dust into storage bins it is advantageous to use $CO_2$ gas for this purpose, because the latter can, as a result of its specific gravity, pass along the inner outer walls of the bin into the lower regions of the latter, where it effectively prevents the condensing out of the steam. An alternative or supplementary possibility for the better fluidization of the coal dust can be achieved by means of gassing cushions or boxes or mushroom-shaped nozzles for the flowing in of inert gas into the vicinity of the bin outlet.

The measures according to this process can be used both in the case of mill drying plants, which are inherently inert or which can externally be made inert. As in such mill drying plants there are generally hot gas generators in the sense of flue gas generators, the heating or warming of the inert gas can take place directly or directly coupled with said hot gas generators. An alternative to inert gas heating is the incorporation of pipe coils into the covering or lining of the burner chamber. Further alternatives in the sense of subsequent equipping of the mill drying plants can be carried out by heating the inert gas in a separate heat exchanger, which is provided directly in the flue gas flow. A further possibility is the installation of pipe coils for the inert gas following the burner chamber, parallel to the flue gas flow.

The inert gas heated in this way can consequently be supplied to the storage bins and the like at appropriate points of need, e.g. the rendering inert of the bin or the rendering inert of the coal dust transport.

With a view to emergency disconnections of the mill drying plant or the flue gas generator when heated inert gas is not available, the inert gas pipe system can be switched to an air flow, so that scaling of the pipe system is prevented.

An essential concept of the invention is to recognize the action connections throughout a mill drying plant system and within the scope of an apparently relatively simple measure to provide a convincing aid to preventing disturbing effects in the overall system.

The invention is described in greater detail hereinafter relative to two diagrammatic embodiments of a flue gas generator.

DESCRIPTION OF THE PREFERRED EMBODIMENTS

Figure 1:
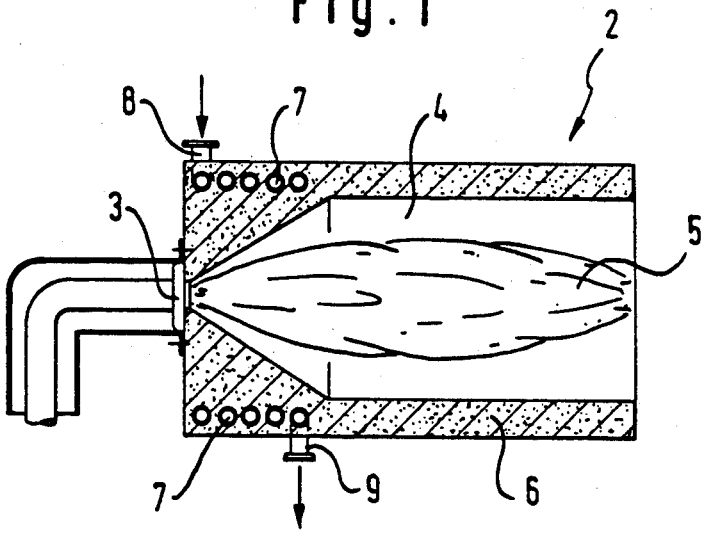
FIG. 1 shows a longitudinal section through a first embodiment of a flue gas generator with an integrated inert gas line, FIG. 2 a comparable section through a second embodiment of a flue gas generator with a casing covering and subsequent flue gas line.

The diagrammatic section according to FIG. 1 shows a flue gas generator 2, in which by means of a burner 3 firing takes place of the inner chamber designed as a burner chamber. The latter is surrounded by a refractory lining 6, in which the burner flame 5 is diagrammatically indicated. In the left-hand area of the stronger lining 6 a pipe coil 7 is provided in the longitudinal direction of said lining 6. This pipe coil 7 is connected to an inlet line 8 and an outlet line 9 for the inert gas to be heated. By means of the inlet line 8 conventionally cold inert gas is supplied by means of corresponding valves, it also being possible to have an air supply, particularly for emergency situations. The outlet line 9 is connected to a corresponding distributor system to storage bins or conveying lines.

Figure 2:
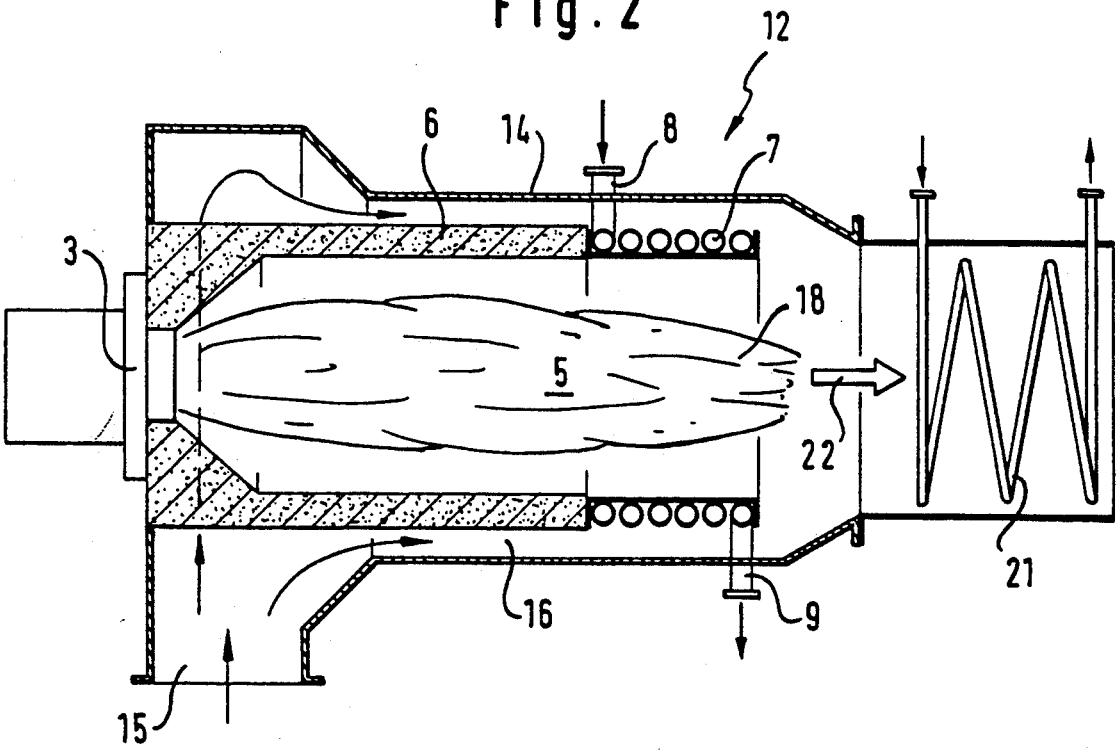

In the embodiment according to FIG. 2 is shown an alternative for an economic heating of the inert gas with a somewhat modified flue gas generator 12. In the sectional representation in the longitudinal direction of the flue gas generator 12 is shown the burner 3 and the lining 6, which is open to the right. The flame 5 is indicated within the burner chamber.

The hot process gas flow 22 is brought about in that the casing jacket 14 is at a limited distance from the outer wall of the lining, so that flow channels are formed around the burner chamber. By means of a blower or through thermal differences process gas is blown or sucked in for heating purposes by means of the inlet 15 and in the front, right-hand area flows as process or hot gas flow 22 through the mill drying plant.

As a first alternative in FIG. 2 is shown the arrangement of a pipe coil 7 for the inert gas adjacent to the right-hand end of the lining 6, so that said coil 7 is located in the vicinity of the flame 5 of the burner 3. Reference can be made to a parallel arrangement to the process gas flow 22.

A further alternative is shown in the right-hand part of FIG. 2, where a heat exchanger 21 is directly incorporated into the process gas flow 22. The initially cold inert gas is supplied through the pipe coil 7 or the heat exchanger 21 and at the outlet side is heated e.g. to a temperature of 50° to 90 ° C., but in all cases above the dew point temperature of the gas-coal dust mixture.

Figure 3:
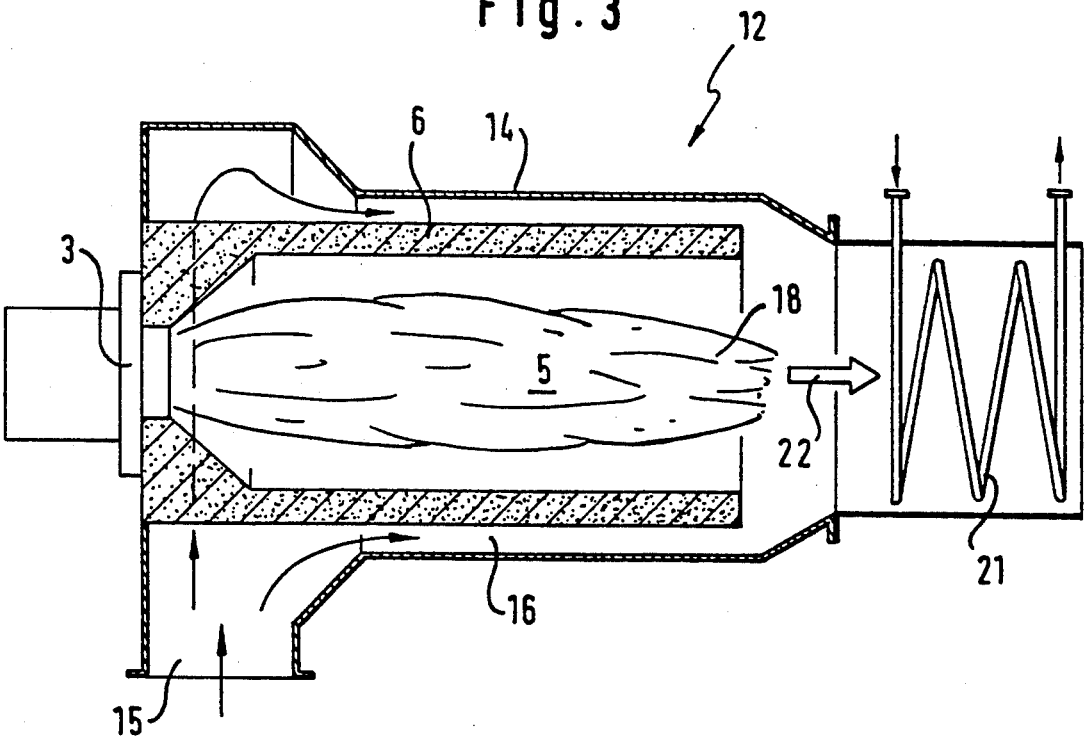
FIG. 3 is a section, similar to FIG. 2, showing a flue gas generator having a heat exchange tube for heating inert gas passing therethrough.

Another alternative is shown in FIG. 3, which shows a system similar to that of FIG. 2. In the system of FIG. 3, burner flame 5 heat process gas 15, as shown in FIG. 2. Inert gas passes through heat exchanger 21 for heating by passage of the heated process gas shown by arrow 22.

Figure 4:
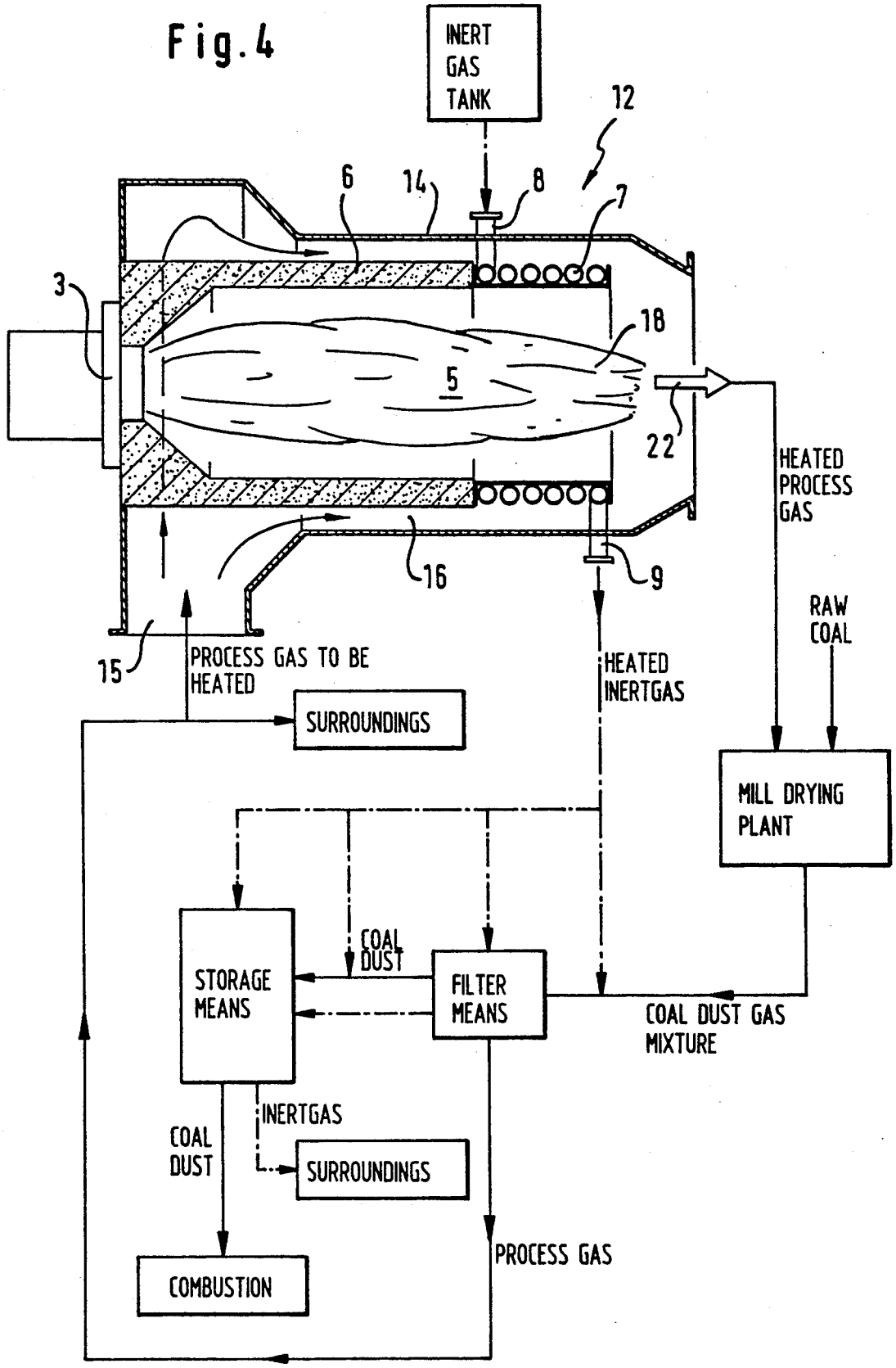
FIG. 4 is a section, similar to FIG. 2, showing a flue gas generator having an integrated inert gas line for heating inert gas and showing a system in which the flue gas generator is used in a mill drying plant.

FIG. 4 illustrates a system of FIG. 2, but without the additional heat exchange tube 21 for passage of inert gas. The inert gas passes through pipe coil 7, similarly to the system shown in FIG. 2. FIG. 4 also illustrates schematically, a flow chart for a conventional mill drying plant which uses the heated process gas and heated inert gas produced by the claimed process, in place of process gas and unheated inert gas of a prior art process.

The invention provides an excellent possibility for avoiding condensation of the residual moisture, even after discharging the coal dust for intermediate storage or the like and this leads to a significant reduction in the fault susceptibility of the entire system or the mill drying plant.

I claim:

1. A process for the treatment of moist, explosive gas-dust mixtures in mill drying plants during fluid transportation and storage of a resulting dust by means of a flue gas and an inert gas, comprising the steps of:

generating heated flue gas;

drying and conveying a moist gas-dust mixture through a mill drying plant by means of the heated gas;

heating inert gas to a temperature above the dew point temperature of residual moisture of said gas-dust mixture;

injecting the heated inert gas at a preselected point during further conveying or storage of said gas-dust mixture; and controlling the volume flow of said heated inert gas during conveying to prevent condensation of the residual moisture contained in said gas-dust mixture.

2. A process according to claim 1, wherein said inert gas is heated to approximately 30° above the dew point temperature.

3. A process according to claim 1 wherein the gas-dust mixture is received in an intermediate storage location and said heated inert gas is injected into said intermediate storage location through a wall thereof.

4. A process according to claim 1, wherein said heated inert gas is a $CO_2$ gas.

5. A process according to claim 1, including the further step of directly heating said inert gas in the vicinity of a flue gas generation.

6. A process according to claim 1, including the further step of indirectly heating said inert gas in the vicinity of a flue gas generation.

7. A process according to claim 1, wherein said gas is a hot process gas.

8. A process according to claim 1, wherein said inert gas is used additionally to said gas.

9. A process according to claim 1, wherein said inert gas is used solely.

* * * * *